United States Patent [19]

Weinman

[11] Patent Number: 4,529,226

[45] Date of Patent: Jul. 16, 1985

[54] DESK PAD

[76] Inventor: Milton Weinman, 5532 S. Shore, Chicago, Ill. 60637

[21] Appl. No.: 663,349

[22] Filed: Oct. 22, 1984

[51] Int. Cl.[3] ..... B42D 1/00

[52] U.S. Cl. ..... 281/15 B; 402/63; 428/43; 428/99; 428/900; D19/95

[58] Field of Search ..... D19/92, 95; 281/15 B; 402/63; 428/99, 900, 43

[56] References Cited

U.S. PATENT DOCUMENTS 409,340 8/1889 Unz ..... 281/15 B
1,398,349 11/1921 Weinman ..... 281/15 B
3,456,373 7/1969 Epton ..... 428/900

FOREIGN PATENT DOCUMENTS 1041088 10/1953 France ..... 281/15 B

*Primary Examiner*—Alexander S. Thomas
*Attorney, Agent, or Firm*—Wallenstein, Wagner, Hattis, Strampel & Aubel

[57] ABSTRACT

A desk pad comprising a one-piece, molded body portion for supporting a writing pad divided into a plurality of smaller writing pads, and having magnetized areas for attaching notes and memoranda in an attention-getting position on the desk pad.

3 Claims, 5 Drawing Figures

DESK PAD

TECHNICAL FIELD

The present invention relates to a desk pad uniquely adapted for use by anyone whose activities, whether they be business, professional, household, or other, require making notes or memoranda concerning those activities in order to maintain them in proper perspective, and to enable a person to regulate and organize his or her daily schedule.

BACKGROUND OF THE PRIOR ART

In my U.S. Pat. No. 1,398,349, issued Nov. 29, 1921, entitled "Desk-Pad", there is disclosed a desk pad construction which comprises a base having an inclined upper face upon which sheets of paper are supported. The sheets are divided into sections, and are clamped onto the base by a holding piece positioned along one margin of the sheets. One of the objects of the invention disclosed in the patent was to provide a desk pad which would eliminate the need to rewrite notes or memorandum each day concerning matters of unfinished business.

BRIEF SUMMARY OF THE INVENTION

The desk pad of the present invention is an improvement over the desk pad disclosed in my U.S. Pat. No. 1,398,349. While incorporating some of the features of my patented desk pad, my improved desk pad differs from my patented desk pad in a number of important respects. More specifically, the desk pad of this invention provides convenient, and strategically located, areas for attaching notes or memoranda in a position where they are segregated from other notes or memoranda on the pad, and where they are clearly visible to the user of the pad. Thus, by way of illustration, my improved desk pad enables a user to attach notes or memoranda having to do with matters of an urgent or important nature such as a luncheon or dinner engagement, a meeting, a telephone message, a plane flight, or the like, in an attention-getting location on the desk pad thereby substantially reducing the possibility that the user will forget, or overlook, the contents of the note or memorandum. The notes or memoranda may comprise sheets torn from the pad itself, or they may comprise printed material, including, for example, theater tickets or tickets to a sporting event. The desk pad of the present invention also is especially constructed to enable personalized information such as the name of the user, and/or the name of the firm or corporation by whom the user is employed, to be displayed in a prominent location on the desk pad. The pad can be fabricated of a lightweight material such as plastic, and can be provided in any desired color for decor purposes.

The foregoing and other features and advantages of the invention will become clear from the description to follow, taken in conjunction with the accompanying drawings, wherein.

DETAILED DESCRIPTION OF INVENTION

Figure 2:
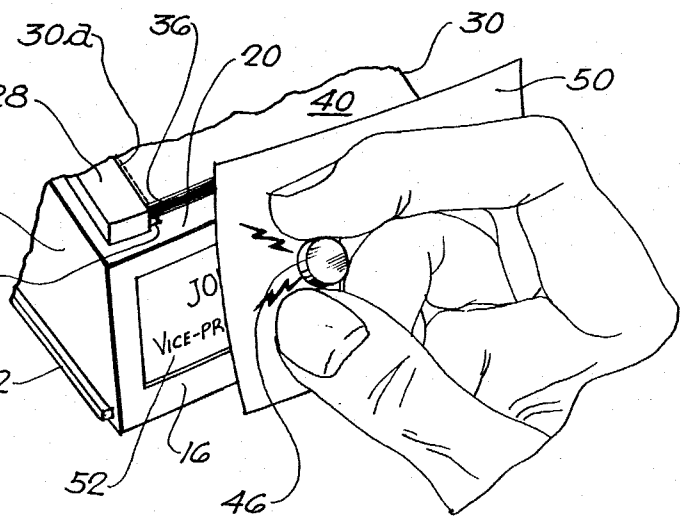
FIG. 2 is an enlarged view in perspective of a portion of said embodiment illustrating the manner in which a note is attached to the pad.

The embodiment of the desk pad of the present invention illustrated in the drawings, and designated generally by reference numeral 10, advantageously comprises a one-piece, molded body portion 12 having a pair of sidewalls 14—14, preferably tapered, an upwardly and rearwardly slanted front wall 16, a rear wall 18, and an upwardly slanted top wall 20. A gutter or trough 22 desirably is provided along the rear margin of the top wall 20 for receiving a pen or a pencil (not shown). The body portion 12 also advantageously is formed with a rearwardly and upwardly slanted panel 24 which extends from the trough 22 to the upper edge of the rear wall 18.

Figure 1:
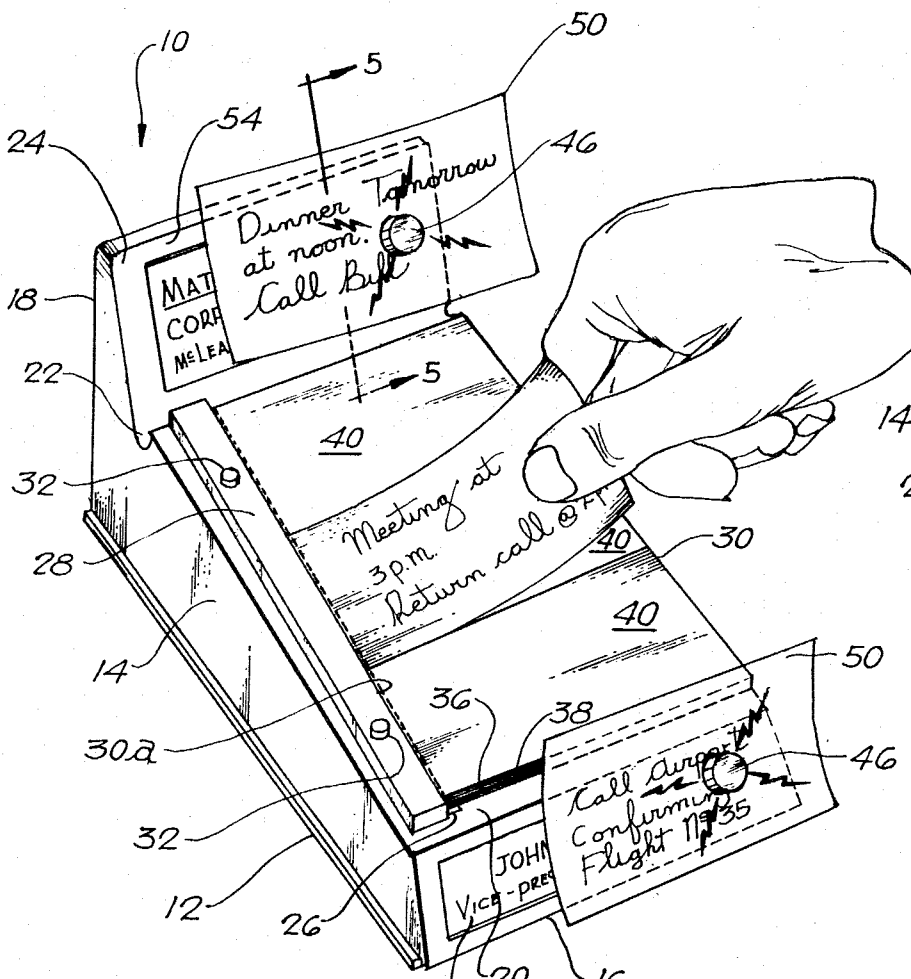
FIG. 1 is a view in perspective of an embodiment of the desk pad of the present invention.
Figure 4:
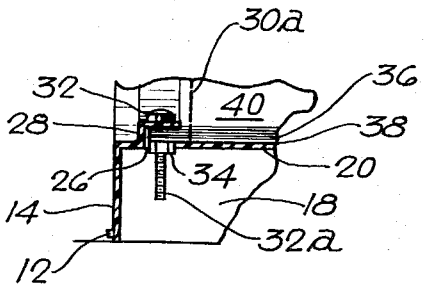
FIG. 4 is a vertical sectional view taken substantially along line 4—4 of FIG. 3.
Figure 3:
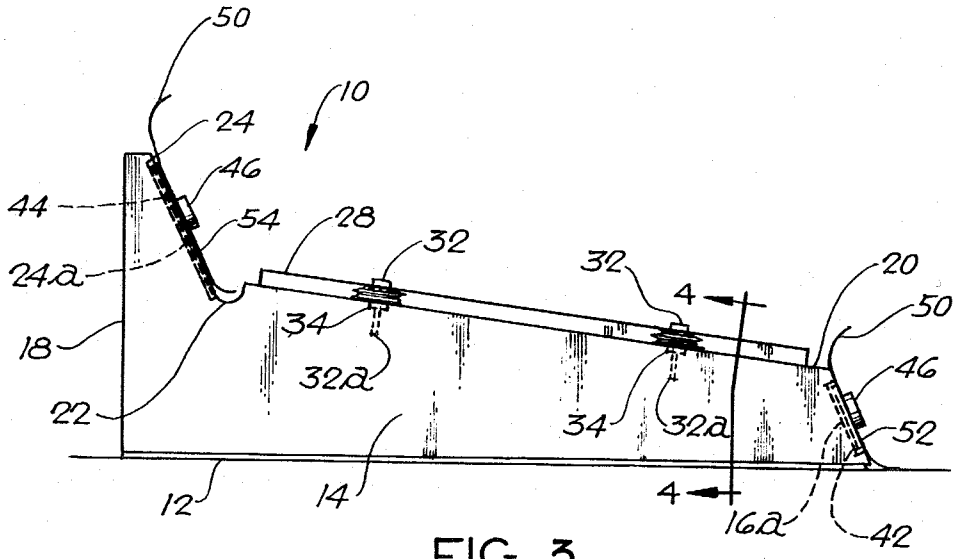
FIG. 3 is a side view in elevation of said embodiment of the desk pad.
Figure 5:
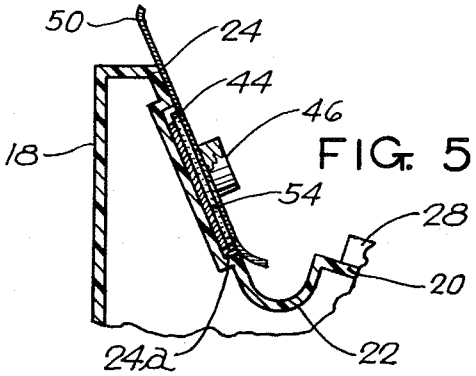
FIG. 5 is an enlarged fragmentary vertical sectional view taken substantially along line 5—5 of FIG. 1.

As best illustrated in FIGS. 1 and 2 of the drawings, the top wall 20 of the body portion 12 does not extend from sidewall to sidewall, but, instead, terminates at a point inwardly from the left sidewall 14, as viewed in FIG. 1, to provide an elongated slot or space 26, the purpose of which will become clear as the description proceeds. Overlying the space 26 is an elongated, upwardly extending, channel-like section 28. The section 28 advantageously is formed integrally with the body portion 12, and is open at its base and along its inner side for receiving an edge portion or margin of a writing pad 30. The upper wall of the section 28 desirably is provided with spaced bores or holes therethrough for receiving fastening means such as screws or bolts 32—32, the threaded shanks **32*a*—32*a* of which pass through registering openings or holes formed in the edge portion of the writing pad 30, and extend through the space 26. Nuts 34—34 can be employed to tightly secure the edge portion of the writing pad 30 in proper position with relation to the section 28 and the top wall 20 of the body portion 12**.

The writing pad 30, as shown, comprises a plurality of sheets of paper 36, adhesively secured together along one edge, and a paperboard backing member 38 adhesively secured along one edge to the stacked sheets of paper 36. Each of the paper sheets 36 is joined to the edge portion of the writing pad 30 which is secured in the section 28 along vertical, longitudinally extending perforations **30*a*, and each of the paper sheets 36 is cut transversely at spaced intervals to provide a plurality of smaller sections or writing pads 40. The number of sections or smaller writing pads 40 is variable, and, if desired, one of the sections, perferably the uppermost section, can comprise a calendar. Notes or memoranda can be written on the sheets comprising the smaller writing pads 40, and can be removed from any one of the pads 40 separately and independently of the sheets comprising the other pads 40**. This arrangement has the advantage of enabling a user of my desk pad to discard those notes or memoranda which no longer are of any interest, and to retain on the pad those notes or memoranda which deal with current matters. In addition, a series of notes or memoranda dealing with the same subject matter can be kept on a single smaller writing pad so that a user of a pad will only have to look in one place to refresh his memory concerning that matter.

My desk pad, as stated hereinabove, is uniquely equipped to "flag" notes or memoranda concerning urgent or important matters such as lunchen or dinner engagements, meetings, telephone messages, plane flights, and the like. To this end, my desk pad is provided with thin metal plates 42 and 44, preferably formed of a ferrous metal such as steel. The plates 42 and 44 advantageously are secured, as by an adhesive, in recesses 16*a* and 24*a* formed in the front wall 16 and the panel 24, respectively, of the body portion 12. The metal plates 42 and 44, in cooperation with magnets 46, serve to position notes or memoranda 50 having to do with urgent or important matters in a clearly visible, conspicuous, attention-getting location on the desk pad. See FIGS. 1 and 2. The magnets 46 can be of any desired shape, and can be conveniently stored during non-use on the back of the front wall 16 of the body portion 12, or they can simply be placed on the face of the front wall 16 or the panel 24.

In a preferred embodiment of my desk pad, the metal plates 42 and 44 desirably are covered by strips 52 and 54, respectively, of a sheet material formed of paper, imitation leather, plastic, or the like, on which personalized information can be readily imprinted. Thus, as illustrated in FIGS. 1 and 2, the name of a company can be imprinted on the strip 54 carried on the panel 24, while the name of the user of the pad can be imprinted on the strip 52 carried on the front wall 16 thereof. The coloring of the strips 52 and 54 can be coordinated with the coloring of the body portion 12 of the desk pad to add to the overall attractive appearance of the pad.

The body portion 12 can be used indefinitely. The writing pad 30 can be replaced as needed by simply removing the bolts 32—32, and securing a new pad on the body portion 12.

Certain modifications in the embodiment of my desk pad as illustrated and described will occur to those skilled in the art from a reading of the foregoing description. It should be understood that such description has been given by way of illustration and not by way of limitation. It is intended to include within my invention any such modifications as fall within the scope of the claims.

What is claimed is:

1. A desk pad having a one-piece body portion provided with a front wall and a rear wall, side walls, and an inclined top wall; a writing tablet removably attached to the body portion and supported on the inclined top wall, said writing tablet comprising a plurality of sheets of paper cut transversely at spaced intervals along the writing tablet to provide a plurality of smaller, separate writing tablets, each of the sheets of paper comprising the smaller writing tablets being independently and separately removable with respect to each other and with respect to the sheets comprising the other smaller writing tablets; an elongated channel-like section integrally formed along one side of the inclined top wall of the body portion, said channel-like section defining an opening for receiving an edge portion of the removable writing tablet, and being provided with releasable fastening means for supporting the writing tablet on the inclined top wall of the body portion; a front upwardly extending slanted lower metal plate panel provided at the front wall of said body portion in communication with said top wall, said panel being provided with magnet attractable means, and a back upwardly slanted extended metal plate panel provided at the rear of the top wall of the body portion, said panel being provided with magnet attractable means, wherein said lower and back upwardly slanted extending plate panels at said rear and front walls are sufficient to enable one or more individual sheets removed from one or more of the smaller writing tablets to be magnetically retained thereon, whereby said removed sheets will be in a position on the front, back or both of said desk pad such that the user of the pad will be able to easily and readily read the written material on them to thereby regulate their time and activities in relation to said written material.

2. A desk pad according to claim 1 wherein the outer surface of the metal plate panels have affixed to the surface of said panels a strip of sheet material on which is imprinted personalized, or the like, information.

3. A desk pad according to claim 1 wherein more than one magnet is provided for magnetically retaining notes or memoranda on the slanted upwardly extending front or back metal plate panel of said desk pad.

* * * * *